US006418580B1

(12) United States Patent
Teran et al.

(10) Patent No.: US 6,418,580 B1
(45) Date of Patent: Jul. 16, 2002

(54) METHOD FOR TREATMENT OF LAUNDRY WITH OZONE

(75) Inventors: Alfredo J. Teran, Cape Canaveral; Nidal A. Samad; Richard G. Wood, both of Merritt Island; John R. Derrick, Jr., Rockledge; Carlos V. Diaz, Merritt Island; Timothy N. Tyndall, Cape Canaveral; Joseph F. Wakim, Palm Bay, all of FL (US)

(73) Assignee: Agrimond, L.L.C., Cape Canaveral, FL (US)

( * ) Notice: Subject to any disclaimer, the term of this patent is extended or adjusted under 35 U.S.C. 154(b) by 0 days.

(21) Appl. No.: 09/394,314

(22) Filed: Sep. 10, 1999

Related U.S. Application Data

(60) Provisional application No. 60/100,002, filed on Sep. 11, 1998.

(51) Int. Cl.[7] ..... D06F 39/08

(52) U.S. Cl. ..... 8/158; 68/13 R; 68/207

(58) Field of Search ..... 8/158; 68/13 R, 68/183, 207

(56) References Cited

U.S. PATENT DOCUMENTS

| | | | | | |
|---|---|---|---|---|---|
| 3,877,152 | A | | 4/1975 | Gorman | 34/43 |
| 5,097,556 | A | | 3/1992 | Engel et al. | 8/158 |
| 5,181,399 | A | | 1/1993 | Engel et al. | 68/13 |
| 5,241,720 | A | | 9/1993 | Engel et al. | 8/158 |
| 5,374,356 | A | | 12/1994 | Miller et al. | 210/641 |
| 5,409,616 | A | | 4/1995 | Garbutt et al. | 210/760 |
| 5,493,743 | A | | 2/1996 | Schneider et al. | 8/149.2 |
| 5,511,264 | A | | 4/1996 | Nishioka et al. | 8/158 |
| 5,625,915 | A | * | 5/1997 | Radler et al. | 8/158 |
| 5,645,608 | A | | 7/1997 | Cooper et al. | 8/137 |
| 5,653,129 | A | | 8/1997 | Jang | 68/13 |
| 5,763,382 | A | | 6/1998 | Cooper et al. | 510/303 |
| 5,765,403 | A | | 6/1998 | Lincoln et al. | 68/13 |
| 5,787,537 | A | | 8/1998 | Mannillo | 8/158 |
| 5,792,369 | A | | 8/1998 | Johnson | 210/748 |
| 5,806,120 | A | * | 9/1998 | McEachern | 8/158 |
| 5,960,501 | A | * | 10/1999 | Burdick | 8/158 |

* cited by examiner

*Primary Examiner*—Philip Coe
(74) *Attorney, Agent, or Firm*—Anton J. Hopen; Smith & Hopen, P.A.

(57) ABSTRACT

A treatment apparatus and method that greatly increases the efficiency and flexibility in using ozone in the laundry process by permitting an operator to set the level of dissolved ozone concentration delivered to the washing machines, depending upon the amount and type of soil on the laundry. Furthermore, the present invention ensures that there is enough dissolved ozone available in the wash water to meet the demand of the washing apparatus. Lastly, the present invention monitors and maintains the desired amount of dissolved ozone to be delivered to the washers.

3 Claims, 3 Drawing Sheets

METHOD FOR TREATMENT OF LAUNDRY WITH OZONE

CROSS-REFERENCE TO RELATED APPLICATIONS

This application claims the benefit of U.S. Provisional Application No. 60/100,002 filed Sep. 11, 1998. The disclosure of the provisional application is incorporated herein by reference.

BACKGROUND OF THE INVENTION

1. Field of the Invention

This invention relates to an apparatus and method for treatment of laundry with ozone, and more particularly, to a variable system for treatment of laundry that is capable of delivering different measured amounts of dissolved ozone concentrations to multiple washing machines.

2. Description of the Background Art

Commercial laundry facilities consume large amounts of chemicals, energy and water during wash cycles. Additionally, a byproduct of commercial laundry facilities is generation of wastewater that must be monitored and treated prior to disposal. A typical laundry facility may consist of multiple single washing machines or continuous load washers (i.e., tunnel washers), or a combination thereof. By way of example, a "typical" commercial laundry facility may include multiple single washing machines that may be from 50 to 600-pound capacity. If a laundry facility consists of four 600-pound and two 100-pound single washers, the yearly production of the facility based on three shifts a day may exceed 12 million pounds. The type of laundry or laundry processed may include, but is not limited to, white and colored towels and bed linens, table clothes, bath mats, blankets and medical supplies. Generally, the type of laundry processed imposes a specific chemical formula that ordinarily includes one or more of the following: detergent, alkali, bleach, anti-bleach, sour and fabric softener. There are generally several filling and draining cycles associated with each wash cycle. If it is necessary to treat for impurities (i.e., filtration of lint) and/or adjust the pH of the wash wastewater prior to disposal, additional chemicals such as sulfuric acid and sodium hydroxide may be required.

There presently exist many types of apparatus and method to treat laundry and wash wastewater with ozone. Ozone may be used to substitute for or to augment detergent use since ozone is a powerful bleaching and oxidizing agent. Utilization of ozone in the laundry process can reduce energy consumption since no hot water is required, save or eliminate chemicals which are potentially harmful to the environment, reduce water consumption and reduce wastewater generation. Consequently, use of ozone in the laundry process can even reduce the time required to wash a load of laundry and therefore reducing the labor and energy costs. The production of ozone is well known in the art and is typically produced using either air or concentrated oxygen. However, prior approaches to treat laundry and wash wastewater with ozone have had limited commercial success for a variety of reasons.

By way of example, previous approaches of laundry ozone systems may inject wash water that is pumped out of a washer, including detergent, with ozone and then pump the wash water back into the washer for the duration of the wash cycle. There are several disadvantages to this approach. First, the detergent present in the wash water will consume the injected ozone almost instantaneously. Secondly, the ozone generator must work full time. Third, there is no mechanism to monitor the amount of ozone that is actually dissolved in the wash water to ensure that the laundry receives a preset level of ozone per wash cycle.

A second approach common in the prior art is for the used wash water to be collected in a tank (typically after it goes through a filtration process or is being recycled). The wash water is then circulated within the tank in which ozone is injected then pumped to the washers' supply tank to maintain water levels. The disadvantage of this approach is the washer may receive inadequately ozonated wash water.

A third approach common in the prior art is to inject generated ozone directly into the washer after the washer is filled with water. The washer typically controls the ozone generator such that when the washer starts, it will activate the ozone generator and the ozone generator will start producing and introducing ozone directly into the washer. A disadvantage of this approach is that modification of the washer is necessary to incorporate a gas feed line into the tub of the washer. Additionally, not all washing machines (i.e., tunnel washers) can be readily modified with gas lines or would require a plurality of ozone gas feed lines.

In summary, previous attempts or teachings for treating for washing laundry with ozone have not provided a mechanism by which there is enough dissolved ozone available in the wash water to meet the demand of the soiled laundry. Specifically, previous systems typically furnish low levels of ozone. Nor have previous methods or apparatus provided a mechanism by which an operator may set and adjust the level of dissolved ozone to match the demand of the laundry. Prior art systems provide no control over the concentration of ozone, no means by which an operator can readily ascertain how much ozone is delivered and whether or not the delivered ozone is consumed by the ozone demand contaminant(s).

Continuing efforts are being made to improve laundry and laundry wastewater apparatus and methods. By way of example, note U.S. Pat. No. 5,493,743 to Schneider et al.; and U.S. Pat. Nos. 5,241,720, 5,181,399 and 5,097,556 to Engel et al. U.S. Pat. No. 5,493,743 discloses an apparatus and method for ozone assisted laundry washing and a wastewater treatment system which preferably is a "closed loop" system which incorporates a process of tiered filtration whereby spent wash water may be collected, filtered and reused. The apparatus and method of Schneider et al. does not teach a mechanism by which an operator may readily select the level of dissolved ozone, and different concentrations of dissolved ozone may be delivered to multiple washing machines. Similarly, U.S. Pat. Nos. 5,241,720, 5,181,399 and 5,097,556 to Engel et al. teach non-adjustable closed loop systems. These patents disclose to add ozone to the wash water prior to use in a washing machine. The disclosure and teachings of these patents are incorporated herein by reference in their entirety.

U.S. Pat. No. 5,625,915 to Radler at al. discloses a complex laundry ozone injection system that utilizes an ozone manifold with a plurality of manifold outlets to deliver ozone. This patent discloses to modify the washer by allowing the water to be pumped out of the washer, injected with ozone, and pumped back into the washer. The disclosure of this patent is incorporated hereby reference in its entirety.

U.S. Pat. No. 5,409,616 to Garbutt et al. discloses a gray water reclamation system to treat and restore cleaning water in a closed loop, recyclable water system.

Another grouping of background patents are those which disclose treatment of wash wastewater. By way of example, see U.S. Pat. No. 5,787,537 to Mannillo which teaches a method to treat wastewater in a closed loop, wash system where ozone is used for purification of the water but not for the actual laundry cleaning process. Ozone is removed by ultraviolet light prior to the water being used to actually clean laundry.

Another grouping of background patents are those which disclose modifications to washing machines or filtration devices. Note U.S. Pat. No. 5,653,129 to Jang that discloses a mechanism by which ozone may be injected directly into the washing means. See also U.S. Pat. No. 5,765,403 to Lincoln et al.; U.S. Pat. No. 5,374,356 to Miller et al.; and U.S. Pat. No. 5,645,608 to Cooper et al.

Another grouping of background patents are those which disclose water formulations. Note U.S. Pat. No. 5,763,382 to Cooper et al. and U.S. Pat. No. 5,511,264 to Nishioka et al.

Not withstanding the existence of such prior art laundry apparatus and methods, there is a need for an improved and more efficient apparatus and method for the treatment of laundry that will achieve the requisite level of cleaning without having deleterious effects on the environment.

Therefore, it is an object of this invention to provide an improvement that overcomes the aforementioned inadequacies of the prior art devices and provides an improvement that is a significant contribution to the advancement of the laundry art.

It is an object of the present invention to provide a laundry treatment apparatus and method which permits the introduction of high levels of dissolved ozone (greater than 1.0 PPM) into the wash water.

It is an object of the present invention to increase the efficiency and flexibility of the utilization of ozone in the laundry process and permit an operator to set the concentration level of dissolved ozone concentration delivered to the washing machines. Furthermore, the laundry treatment apparatus and method of the present invention can deliver multiple concentration levels of ozonated water to different washing machines concurrently.

Another object of this invention is to provide a laundry treatment apparatus and method that is self-monitoring and maintains the selected level of dissolved ozone for delivery to the washing machines.

Another object of this invention is to provide a laundry treatment apparatus and method which eliminates the need for chemicals and additives such as bleach, Anti-Chlor (anti-bleach), sour and fabric softener.

Another object of this invention is to provide a laundry treatment apparatus and method that greatly reduces the amount of detergent and alkali used in the laundry process.

Another object of this invention is to provide a laundry treatment apparatus and method that greatly reduces the amount of water usage.

Another object of this invention is to provide a laundry treatment apparatus and method that greatly reduces labor and energy costs thereby increasing productivity due to reduction in wash cycle time.

Another object of this invention is to provide a laundry treatment apparatus and method that permits flexibility in setting the desired dissolved ozone concentration and maintains the desired concentration continually so long as the system is in operation.

Another object of this invention is to provide a laundry treatment apparatus and method that is capable of attaining a higher or lower level of dissolved ozone upon adjustment in a matter of minutes.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a treatment apparatus and method that greatly increases the efficiency and flexibility in using ozone in the laundry process by permitting an operator to set the level of dissolved ozone concentration delivered to the washing machines, depending upon the amount and type of soil on the laundry. Furthermore, the present invention ensures that there is enough dissolved ozone available in the wash water to meet the demand of the washing apparatus. Lastly, the present invention monitors and maintains the desired amount of dissolved ozone to be delivered to the washers.

As used herein, the term "laundry" shall mean all washable fabrics and items. The apparatus and method of the present invention is drawn to an apparatus which incorporates an ozone system which serves as a water purification means, a supply tank and a transfer tank in fluid flow communication with multiple washing machines. The dissolved ozone level is monitored and controlled at a set point in the supply tank while the oxidation reduction potential (ORP) is monitored and controlled in the transfer tank. In operation, the apparatus of the present invention monitors the water levels in the supply and transfer tanks and automatically fills both tanks to the proper level and maintains the tanks full. When the tanks are full, the water in the supply tank is circulated between the supply tank and the ozone system until the desired ozone set point is reached. At this point, the water in the transfer tank is circulated until the ORP set point is reached. When both control parameters are reached, the ozone system will automatically shut off. The system will automatically turn on and the cycle will be repeated when the water level in the supply tank drops or the ozone level in either tank drops. A feed pump independent of the ozone system circulation loop, provides ozonated water (at the predetermined ozone level) to the washers on demand. More specifically, when the apparatus of the present mechanism senses a water demand, ozonated water will be supplied from the supply tank to the washer(s) and pre-treated water from the transfer tank will be pumped to the supply tank. The method of the present invention will continue automatically as long as there is a demand for water or ozone in either supply or transfer tank.

The key to successfully utilizing ozone in the laundry process is to ensure sufficient dissolved ozone in the wash water to meet demand from the washing machine(s). It is not sufficient to simply generate "more" or higher levels of ozone gas, rather, it is necessary to ensure that the ozone goes into solution and is maintained at a constant concentration. The apparatus and method of the present invention permits flexibility in setting the desired dissolved ozone concentration and permits the simultaneous delivery of different dissolved ozone concentrations to multiple washers. Once the operator sets the desired concentration, it will be maintained continually by the system so long as the system is in operation. If for some reason the operator needs to adjust to a higher or lower level of dissolved ozone, it can be done readily and the system will achieve the new dissolved ozone concentration in a matter of minutes. Via a control system, preferably a programmable logic controller (PLC), the present invention provides the ability to continuously monitor the concentration of the dissolved ozone being delivered to the washing machine(s). As a safety feature, in use the apparatus and method of the present invention will deactivate the washing machine's supply pump if the concentration of dissolved ozone is below the operator's set point.

In use the present apparatus and method should greatly reduce the amount of detergent and alkali necessary to clean even the most soiled laundry. Based upon initial pilot study information, no hot water is required to operate the laundry apparatus, and detergent usage will be reduced on average of 50–70%. Consequently, the number of required rinses may be reduced by 35–40% which can result in a 35–40% water/sewer savings. The reduction in the number of required rinses can also reduce the duration of the wash cycle between 30–40%. Additionally, based upon initial pilot study information, the present apparatus and system will completely eliminate the need for pH adjustment.

The foregoing has outlined rather broadly the more pertinent and important features of the present invention in order that the detailed description of the invention which follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

DETAILED DESCRIPTION OF THE PREFERRED EMBODIMENT

Figure 1:
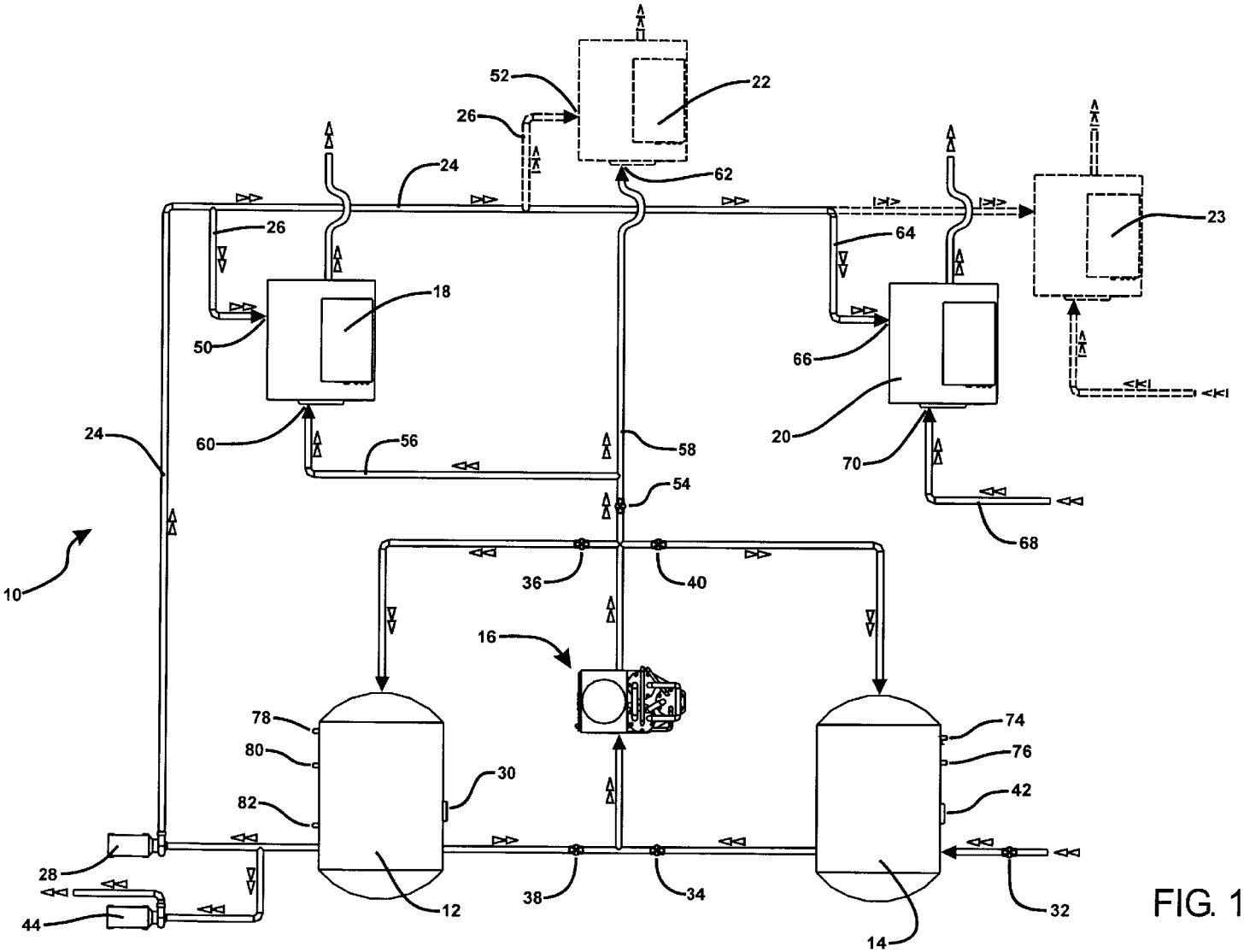
FIG. 1 is a flow diagram illustrating the laundry treatment apparatus and method of the present invention.
Figure 2:
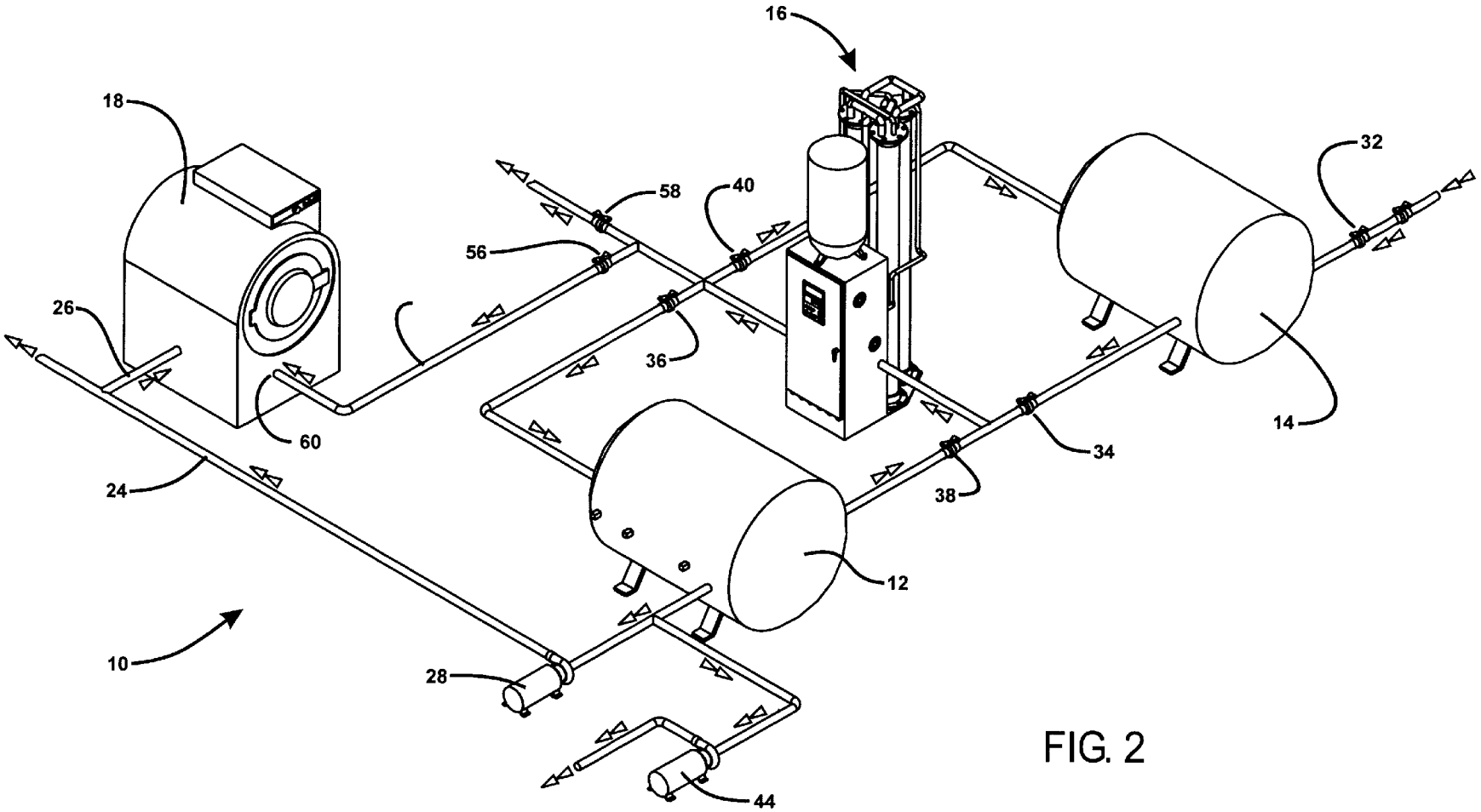
FIG. 2 is a schematic illustration of the laundry treatment apparatus and method of the present invention.

With reference to the drawings, and in particular FIGS. 1 and 2, a new and improved laundry treatment apparatus and method embodying the principles and concepts of the present invention and generally designated by the reference number 10 will be described.

It is desirable for an operator of a laundry facility to have the ability to set the desired level of dissolved ozone in the wash water and have the ability to deliver different levels of dissolved ozone in the wash water to different washes simultaneously. The amount of dissolved ozone that is required in the wash water to clean laundry is dependent upon the amount and type of soil on the laundry. By way of example, and in no way intended to limit the scope of the present invention, it may be desirable to set the dissolved ozone concentration to a low level (i.e., 1.0 PPM) for colored laundry while maintaining the ability to deliver a medium level (i.e., 2.0–3.0 PPM) of dissolved ozone to a washer for normal soiled laundry and a high level (greater than 4.5 PPM) of dissolved ozone to a washer for stained or heavily soiled laundry.

Key to the present invention is the ability to ensure that ozone goes into solution and that a constant level of dissolved ozone is available to meet the demand of the washer (s). Any commercially available ozone machine or system may be used in-line in association with the system of the present invention, provided it can attain target purification and mass transfer requirements. However, in a preferred embodiment, the ozone system utilized as the water purification means is an AJT Tech$_2$Ozone® machine as disclosed and typified in U.S. Pat. No. 5,785,864 to Teran et al. and U.S. application Ser. No. 09/123,015, the disclosures of which are incorporated herein their entirety by reference. The preferred ozone system will be discussed in greater detail below.

As shown in FIGS. 1 and 2, the apparatus of the present invention comprises in combination at least a plurality of tanks 12, 14 and at least one ozone system which incorporates an ozone system 16 in fluid flow communication with one another and with one or a plurality of washing means 18, 20. Preferably the washing means shall be a washing machine. Each tank shall include at least one water inlet and one water outlet. One skilled in the art can readily add additional washers 22 and 23 to the apparatus. As used herein, washing machines or washers shall mean larger capacity machines than those found in a typical home and suitable for use in a commercial laundry facility, laundromat or hotel. The washing machines may be single load washers or tunnel washers. Tunnel washers are continuous washing machines that incorporate multiple pockets whereby, at set intervals, laundry is introduced into the tunnel washer while the same amount of laundry exits the tunnel washer. Laundry typically is retained in each pocket for about two minutes while water is fed into the tunnel washer at different locations. Typically, the laundry and water travel counter to each other.

Each washing machine is capable of being operated independently and is in fluid flow communication with ozonated wash water from a supply tank 12 via a supply conduit 24 and 26.

If converting a washing machine from chemical operation to ozone operation, the hot and cold water valves are closed. Any commercially available tank, such as those sold by Chemical Containers, Inc., may be utilized in the present application.

Preferably, the apparatus and method of the present invention may be monitored and controlled via a control system (not shown) that utilizes a programmable logic controller (PLC), which will incorporate use of in-line analytical instrumentation for remote access. However, it should be well understood by one skilled in the art that the control system could also be relay breakers, manually valve operation, or a computer software system. Any commercially available PLC such as those sold by PLCDirect™, Incorporated may be utilized in the present application.

Generally speaking, three parameters may be used in controlling the apparatus and method of the present invention. These parameters are, in preferred priority, (1) the water level in the supply tank 12, (2) the dissolved ozone concentration of the water in the supply tank 12 and (3) the oxidation-reduction potential (ORP) of the water in the transfer tank 14. An operator of the present invention can program the system and PLC to set the operation of the apparatus of the present invention based upon the above parameters.

Depending on how the operator programs the PLC, the following steps will occur upon activation of the apparatus and method of the present invention to ensure there is adequate ozonated wash water, with the appropriate level of dissolved ozone, immediately available upon demand to the washer(s). In a preferred approach, water is first pumped by a pump (not shown) from the transfer tank 14 to the supply tank after ozonation in the ozone system 16. Second, the water in the supply tank 12 is circulated through the ozone system 16 back to the supply tank 12. Third, water in the transfer tank 14 is circulated through the ozone system back to the transfer tank 14. Preferably the ozone system of the present invention incorporates a pump means which maintains the level of water in the supply tank and circulates water through the ozone system.

In initial start up, water from a water supply (usually city water—not shown) is pumped through a first valve 32 via a water conduit to fill the transfer tank 14 and the supply tank 12 via actuated valve 34 and valve 36. After initial start-up, assuming both tanks 12 and 14 are full, which should always be the case upon initiation of the laundry treatment system of the present invention, the first system step is completed. The PLC then will detect the dissolved ozone concentration in the supply tank 12 through use of a dissolved ozone monitor 30. Preferably, the dissolved ozone monitor 30 is situated at the bottom of the tank by the supply pump intake. The dissolved ozone monitor should be capable of reading dissolved ozone concentrations up to at least 20 PPM. If the concentration of dissolved ozone is below the desired level set by the laundry operator, then valves 38 and 36 are activated, whereby the water in the supply tank 12 is circulated through the ozone system 16. The water will keep circulating from the supply tank 12 to the ozone system 16 and back to the supply tank until the desired dissolved ozone concentration is attained.

Once the water in the supply tank 12 reaches the desired dissolved ozone concentration, it is ready to be used as wash water. The PLC will check the ORP level, via an ORP monitor 42, in the transfer tank 14. If the ORP is below the desired level set by the operator, then the water in the transfer tank will be circulated through the ozone system 16 via valves 34 and 40. Water from the transfer tank will continually circulate from the transfer tank to the ozone system and back to the transfer tank until the ORP set point is satisfied. It is desirable to "pre-treat" the water in the transfer tank to reduce the ozone demand in the water and build up ozone levels. To increase the efficiency of the apparatus and method of the present invention, the dissolved ozone concentration or oxidation reduction potential of the water in the transfer tank 14 is preferably in the range of 0.5–1.0 PPM (ORP of 800–1000 mV).

It should be well understood by one skilled in the art that a dissolved ozone monitor may be used instead of an ORP in the transfer tank or, alternatively, an ORP is not required in the transfer tank, though it is preferable. Use of an ORP in the transfer tank 14 helps an operator determine when the water in the in the transfer tank is "pre-treated" or "pre-ozonated" (typically an ORP of greater than 800 mV) and aids in trouble shooting.

When ozone is first injected into the water before it starts to build any residual ozone, all the ozone consuming contaminants should be destroyed. Therefore, when water is transferred from the transfer tank to the supply tank, it will not require a long period of time for the water in the supply tank to achieve the preset dissolved ozone concentration thereby increasing the efficiency of the apparatus.

While the water in the transfer tank is being circulated through the ozone system 16, the PLC continually monitors the water level in the supply tank and the dissolved ozone concentration of the water in the supply tank. If any of the parameters falls below the desired set point, then the PLC will terminate water circulation from the transfer tank through the ozone system and fill the supply tank or circulate water from the supply tank through the ozone system as necessary. In a preferred embodiment, a series of solenoid valves (32, 34, 36, 38 and 40) direct the flow of water between the water supply, the tanks 12 and 14 and the ozone system 16.

Wash water is delivered to the washers by one or more supply pumps 28 and 44, depending on the number of washers. All supply pumps are controlled via the PLC and will not operate if the dissolved ozone concentration in the supply tank 12 is below the set point. Specifically, if the dissolved ozone falls below the set point, the dissolved ozone monitor will open the circuit for the supply pump forcing it to stop pumping. An operator may adjust the amount of dissolved ozone in the wash water by changing the set points on the dissolved ozone monitor.

Depending upon the configuration of the laundry facility, multiple ozone systems and accordingly sized tanks may be required, as well as multiple water circulation loops. By way of example, a laundry facility operating four 600-pound washers would require multiple ozone systems capable of delivering 600 gallons of ozonated water (i.e., 2.0–3.0 PPM) upon demand (i.e., AJT Tech$_2$Ozone Model T$_2$O-51P).

As illustrated in FIG. 1, the operator sets the maximum dissolved ozone concentration that may be delivered to the washer(s) directly from the supply tank 12. Typically, for normal commercial laundry, the dissolved ozone concentration will be set at 2.0 PPM. If, in operation, washing machines 18 (and 22) are washing normal laundry (i.e., not extremely soiled), then upon demand the supply pump 28 will draw ozonated wash water directly from the supply tank for deliver to the washer via conduit 24. The ozonated wash water is either fed directly into a tunnel washer or via a water supply port 50 and 52 in the case of a single load washer. For ease of discussion, the apparatus and method of the present invention will be discussed in terms of utilizing multiple single load washers. Many commercially available single load washers incorporate two water supply ports. As used herein, water having a dissolved ozone concentration of 0 PPM is potable water. Wash water having a dissolved ozone concentration of 1.0 PPM will be characterized as having a low concentration, water having a dissolved ozone concentration of 2.0–3.0 PPM will be characterized as having a medium concentration, and water having a dissolved ozone concentration of greater than 4.5 PPM will be characterized as having a high concentration.

In use, a water supply of the present invention that is being delivered make-up water or ozonated water having a low or medium concentration of dissolved ozone can be characterized as "cold" (preferably 0–3.0 PPM). Conversely, a water supply port of the present invention which is being delivered ozonated water having a higher concentration of dissolved ozone (2.0–4.5 PPM) can be characterized as "hot". Water supply ports 50, 52 and 70 are cold ports. Water supply ports 60, 62 and 66 are hot ports.

If it is desired to wash a load of heavily soiled laundry in washing machines 18 and/or 22 then, upon demand, ozonated wash water having a high concentration of dissolved ozone will be drawn directly from the ozone system 16. Specifically, the PLC will actuate valves 38 and 54 to deliver wash water straight from the ozone system before the water circulates back to the tank. In other words, the water will be pumped from the supply tank 12, through the ozone system 16 where the dissolved ozone concentration is increased, and then delivered to washers 18 and/or 22 via water conduits 56 and 58 through the hot water supply ports 60 and 62 of the washers. Therefore, by utilizing both the "hot" and "cold" water supply ports of washers 18 and 22, a dissolved ozone concentration range of 2.0 to greater than 4.5 PPM can be achieved. Similarly, by utilizing both the "hot" and "cold" water supply ports of washers 20, a dissolved ozone concentration range of 0 to 3.0 PPM can be achieved.

The innovative idea of using both multiple water supply ports of the washers, combined with the capability of delivering from either supply tank or directly from ozone machine, gives this invention its flexibility.

Commercial washers are generally programmable and contain internal washer controller, hereinafter control means (not shown), which typically control the introduction of hot and cold water. Each water supply port of a washer has an electrical solenoid valve that is generally closed. When the washer demands water, the washer's controller sends an electrical signal to the solenoid valve to open, thereby filling the water (and conversely closing the solenoid valve when the washer is full). The present system utilizes the washer's control means to deliver the desired amount of dissolved ozone to the washer upon demand. The apparatus and method of the present system could also incorporate a flow switch or a pressure switch as a control means to regulate the introduction of ozonated water.

In operation, it should be readily apparent that a load of regular laundry could be washing in a washer 18 where the ozonated wash water is supplied from the supply tank 12 via conduit 24 and introduced through the cold water supply port 50, while a load of heavily soiled laundry could be simultaneously washing in a washer 22 where the ozonated water is supplied directly from the ozone system 16 (closing valve 34, 36, 40 and opening valve 54) via conduit 58 through the hot water supply port 62.

It should be well understood that ozonated water may be provided to washers 18 and 22 through both the hot and cold water supply ports, thereby permitting further adjustment of the dissolved ozone concentration of the wash water by the washers control system for each fill cycle.

FIG. 1 further illustrates a configuration whereby a washer 20 (and an additional washer 23) may wash laundry (such as colored laundry) at a dissolved ozone concentration of 3.0 PPM or legs. Specifically, in operation, a supply pump would deliver ozonated water from the supply tank 12 (presumably set in the range of 2.0 PPM) directly via conduits 24 and 64 through the hot water supply port 66. If a lower concentration of dissolved ozone is desired, city water or make-up water may be delivered via conduit 68 through the cold water supply port 70, thereby diluting the concentration of dissolved ozone.

Once set by the operator, the apparatus and method of the present invention is automatic and there is no need for further operator intervention.

Figure 3:
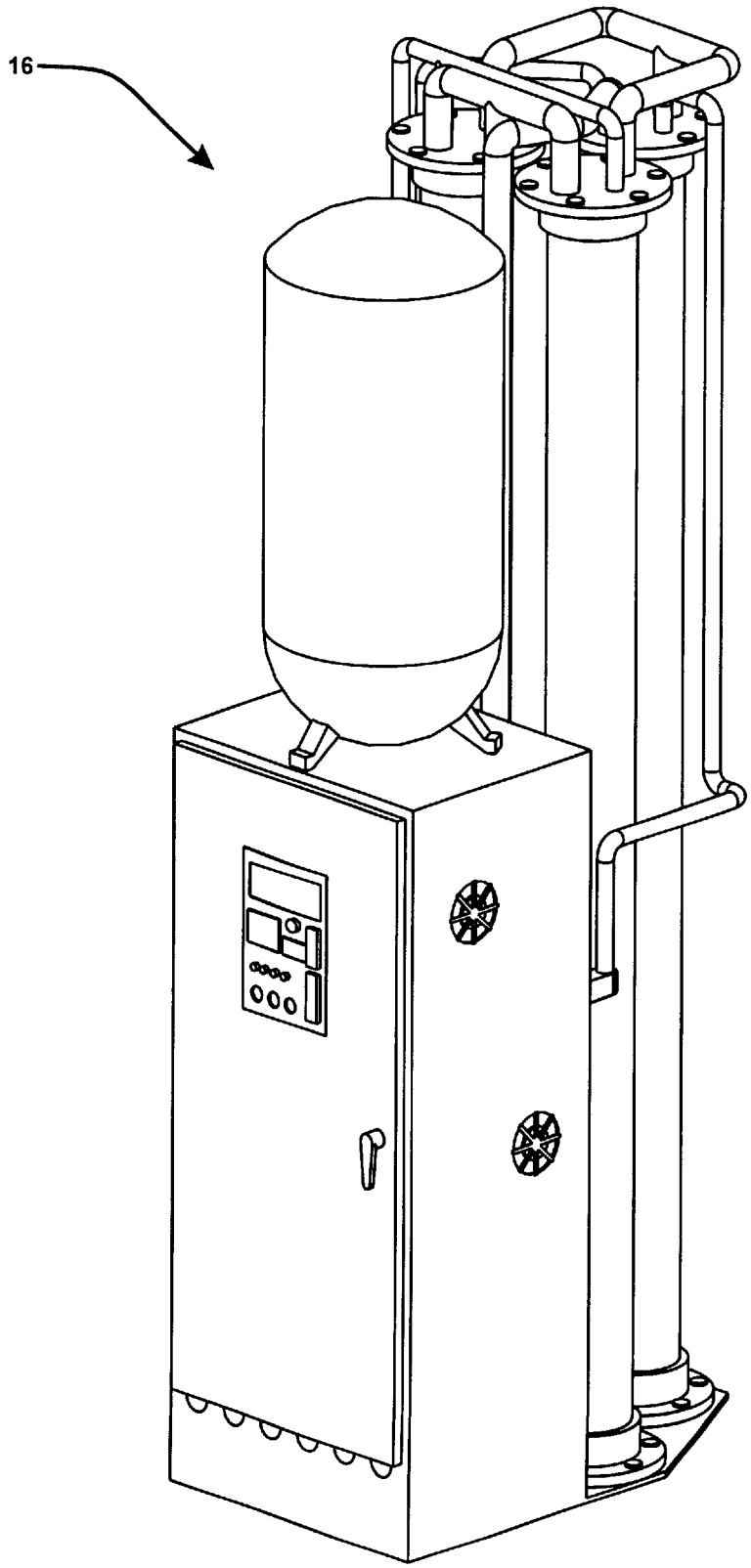
FIG. 3 is an illustration of a preferred ozone system that may be incorporated into the laundry treatment apparatus of the present invention. Similar reference characters refer to similar parts throughout the several views of the drawings.

As illustrated in FIG. 3, the ozone system preferably incorporates a plurality of contact columns sized to ensure a minimum of contact time of within the columns. Each contact column is a longitudinally extending elongate hollow enclosure having a closed top-portion, a closed bottom portion, and a gas tight interior space therein. An ozone supplier means is disposed between the water source and said plurality of contact columns whereby ozone may be introduced into the water flow. Furthermore, an ozone source is connected in fluid flow communication with said plurality of contact columns. In operation in the present system, any off gas from the ozone system is directed into the transfer tank 14 thereby increasing the efficiency of the apparatus and system.

The ozone system of the present invention incorporates a supply pump (not shown) which draws feed water from a source. The water then passes through a valve or water flow adjustment means. Any commercially available water pump may be used in the present application. The flow rate of the water may be adjusted to the desired rate by means of a water flow adjustment means.

One skilled in the art may readily ascertain the required contact time and specific size of the contact columns. Utilizing the following calculations, the ozone generator and water purification system can be readily sized for particular applications. First, the type and general characteristic of the water source (water quality and flow rate) must be analyzed. Then the ozone dosage and contact time required are ascertained. Generally speaking, ozone generator size=flow rate (in gal/min)×0.012×ozone dosage required (in mg/l) equals lbs./day.

In a preferred embodiment, the ozone system utilized in the present invention is capable of attaining 65% or better mass transfer efficiency. If the ozone generator produces 50 g/hr of ozone and the water flow is 50 gallons per minute, then the theoretical dissolved ozone concentration (PPM) equals:

$$50\times1000/(50\times3.785\times60)=4.40 \text{ PPM of dissolved ozone.}$$

However, if after testing, the dissolved ozone level is only 3.0 PPM dissolved ozone, then the overall mass transfer efficiency is $$3.0 \text{ PPM}/4.4 \text{ PPM}=68.2\%$$

The apparatus and method of the present invention may be readily sized based in part upon the capacity of the washer(s) (pounds) and the number of washers. The present system may optionally include the use of water softeners to remove hardness from the local water supply.

In a further refinement, the supply and transfer tanks incorporate a plurality of level switch(es) (72, 74, 76, 78, and 80). Both tanks 12 and 14 incorporate upper 78, 74 and middle 80, 76 switches. The supply tank 12 additionally incorporates a lower switch 82. The upper and middle switches aid in filling the tank(s). Assuming upon start-up that both of the tanks are full, as water is withdrawn the water level in the tanks drops. When the water level reaches the middle switch 80 and 76, the tank starts filling until the water level reaches the top switches. Lower switch 82 ensures that the supply tank will not inadvertently empty which could cause the supply pump(s) to run empty and lose their prime.

The unique configuration and efficiency of the ozone system of the apparatus of the present invention permits flexibility in setting the desired dissolved ozone concentration and permits the simultaneous delivery of different dissolved ozone concentrations to multiple washers. Once the operator sets the desired concentration, it will be maintained continually by the system so long as the system is in operation. If for some reason the operator needs to adjust to a higher or lower level of dissolved ozone, it can be done readily and the system will achieve the new dissolved ozone concentration in a matter of minutes. Via the PLC, the present invention provides the ability to continuously monitor the concentration of the dissolved ozone being delivered to the washing machine(s). As a safety feature, in use the apparatus and method of the present invention will deactivate the washing machine's supply pump if the concentration of dissolved ozone is below the operator's set point.

The present disclosure includes that contained in the appended claims, as well as that of the foregoing description. Although this invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. Now that the invention has been described,

What is claimed is:

1. A method of treating laundry with ozone comprising the steps of:

analyzing the characteristics of the laundry to be washed;

obtaining a properly sized apparatus for the treatment of laundry comprising:

a plurality of tanks, each of said tanks having an interior space and each of said tanks having a water inlet and a water outlet, wherein a first tank is a transfer tank and a second tank is a supply tank;

a water source connected in fluid flow communication with said tanks;

a water purification means disposed between said water source and said supply tank in fluid flow communication with said tanks wherein ozone may be introduced into the water flow to provide wash water having a dissolved ozone concentration wherein said water purification means further comprises a control means;

the supply tank further comprising a monitor to determine the dissolved ozone concentration of the wash water, at least one washing means in fluid flow communication with said supply tank and said water purification means wherein said washing means further comprises a plurality of wash water supply ports wherein a first wash water supply port is cold and a second wash water supply port is hot;

whereby wash water having a desired dissolved ozone concentration may be delivered to said washing means;

setting the concentration level of dissolved ozone to be delivered to said washing means;

introducing ozone into said wash water;

maintaining a supply of wash water in said supply tank;

re-circulating the wash water from the supply tank through said water purification means if the concentration of dissolved ozone is below the desired dissolved ozone concentration until the desired dissolved ozone concentration is attained; and delivering ozonated water having a preset dissolved ozone concentration to said washing means upon demand.

2. The method as in claim 1, further comprising the steps of:

checking the oxidation reduction potential of water in the transfer tank and, if the oxidation reduction potential is below the desired level, circulating the water from the transfer tank through said water purification means until the desired oxidation reduction potential is attained.

3. The method as in claim 1, further comprising the steps of:

delivering wash water having a desired dissolved ozone concentration via the cold and hot water supply ports of the washing means whereby multiple levels of ozonated water may be provided to said washing means concurrently.

* * * * *

UNITED STATES PATENT AND TRADEMARK OFFICE
Certificate

Patent No. 6,418,580 B1 Patented: July 16, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Alfredo J. Teran, Cape Canaveral, FL; Nidal A. Samad, Merritt Island, FL; Richard G. Wood, Merritt Island, FL; John R. Derrick, Jr., Rockledge, FL; Carlos V. Diaz, Merritt Island, FL; Timothy N. Tyndall, Merritt Island, FL; Wesley Todd Willoughby, Merritt Island, FL; and Louis V. Mangiacapra, Mims, FL.

Signed and Sealed this Twenty-Second Day of July 2003.

RANDY GULAKOWSKI
*Supervisory Patent Examiner*
Art Unit 1746